US005316660A

United States Patent [19]

Kuno

[11] Patent Number: 5,316,660

[45] Date of Patent: May 31, 1994

[54] HYDRODELAYED THERMAL CRACKING PROCESS

[76] Inventor: Masaya Kuno, 7-13, Tsuruma 1-chome, Machida City, Tokyo, Japan

[21] Appl. No.: 19,813

[22] Filed: Feb. 12, 1993

Related U.S. Application Data

[63] Continuation-in-part of Ser. No. 791,532, Nov. 14, 1991, abandoned.

[30] Foreign Application Priority Data

Nov. 15, 1990 [JP] Japan ..... 2-307135

[51] Int. Cl.[5] ..... C10G 65/00; C10G 65/10

[52] U.S. Cl. ..... 208/76; 208/59; 208/72; 208/80; 208/82

[58] Field of Search ..... 208/72, 76, 59, 82, 208/80

[56] References Cited

U.S. PATENT DOCUMENTS

| | | | |
|---|---|---|---|
| 2,176,353 | 10/1939 | Morrell | 208/76 |
| 2,748,061 | 5/1956 | Olberg et al. | 208/76 |
| 3,714,282 | 1/1973 | Downs et al. | 208/76 |
| 3,843,508 | 10/1974 | Wilson et al. | 208/76 |
| 4,424,117 | 1/1984 | Kuno | 208/211 |
| 4,559,129 | 12/1985 | Reynolds et al. | 208/59 |
| 4,559,130 | 12/1985 | Reynolds et al. | 208/59 |
| 4,560,465 | 12/1985 | Yu et al. | 208/59 |
| 4,564,439 | 1/1986 | Kuehler et al. | 208/59 |
| 4,581,124 | 4/1986 | Gomi et al. | 208/48 R |
| 4,770,764 | 9/1988 | Ohtake et al. | 208/59 |
| 4,792,389 | 12/1988 | Frohn et al. | 208/76 |

*Primary Examiner*—R. Bruce Breneman
*Assistant Examiner*—Lorna M. Douyon
*Attorney, Agent, or Firm*—Wenderoth, Lind & Ponack

[57] ABSTRACT

The present invention provides a process for hydrodelayed thermal cracking in combination with hydrostripping, which comprises feeding crude oil from a surge tank to a crude oil stripper via a feed line; separating the crude oil into a lighter fraction and a heavier fraction in the crude oil stripper; subjecting the lighter fraction to hydrodesulfurization; feeding the heavier fraction from the crude oil stripper to a first storage tank; hydrothermally cracking the heavier fraction for at least 10 minutes under a hydrogen pressure in the first storage tank; introducing a bottom residue of the first storage tank into a second storage tank or the feed line, and subjecting a cracked and vaporized fraction of the first storage tank to hydrodesulfurization; hydrothermally cracking the residue introduced into the second storage tank under a higher hydrogen pressure than the hydrogen pressure of the first storage tank; subjecting a portion of a bottom residue of the second storage tank to hydrodemetallization, hydrodesulfurization and hydrocracking, and introducing another portion of the bottom residue of the second storage tank into the feed line; and supplying hydrogen to the surge tank to facilitate pressurizing the crude oil in the surge tank.

4 Claims, 1 Drawing Sheet

HYDRODELAYED THERMAL CRACKING PROCESS

CROSS-REFERENCE TO RELATED APPLICATION

This application is a continuation-in-part of Ser. No. 07/791,531, filed Nov. 14, 1991, now abandoned.

BACKGROUND OF THE INVENTION

This invention relates to a crude cracking process, especially a process which helps to reduce the production of a heavier fraction of the process, i.e. asphaltene and the like. More particularly, it is concerned with the pretreatment of crude before processing to the following unit, that is a hydrostripping process or bottomless refinery. In a conventional topping unit, residue is treated and cooled by steam to stop polymerization, and is drawn off as quick as possible to be fed to a middle tank or to the next processing step. However it is common that C.C.R. carbon and asphaltene have shown an increase during the process of the conventional processing.

In order to improve defects of the conventional process, a new hydrostripping process as described in U.S. Pat. No. 4,424,117 was invented by the present inventor. The invention therein is a hydrostripping process which is the combination of crude oil distillation and hydrotreating of a distillate overhead, wherein crude oil mixed with a large amount of hydrogen is distilled under high temperature and pressure and separated into a distillate overhead to be hydrotreated, and a heavy residue. Crude oil is separated into two fractions, a lighter fraction and a heavier fraction. The lighter fraction may be charged directly to the following HDS unit with accompanied hydrogen, while no treatment of the heavier fraction is proposed in the invention of U.S. Pat. No. 4,424,117.

SUMMARY OF THE INVENTION

An object of the present invention is to provide a very efficient and economical treatment process of the heavy residue of the hydrostripping process.

This object is achieved by subjecting the heavy residue of the hydrostripping process to a two-stage hydrodelayed thermal cracking process.

DESCRIPTION OF PREFERRED EMBODIMENTS

Figure 1:
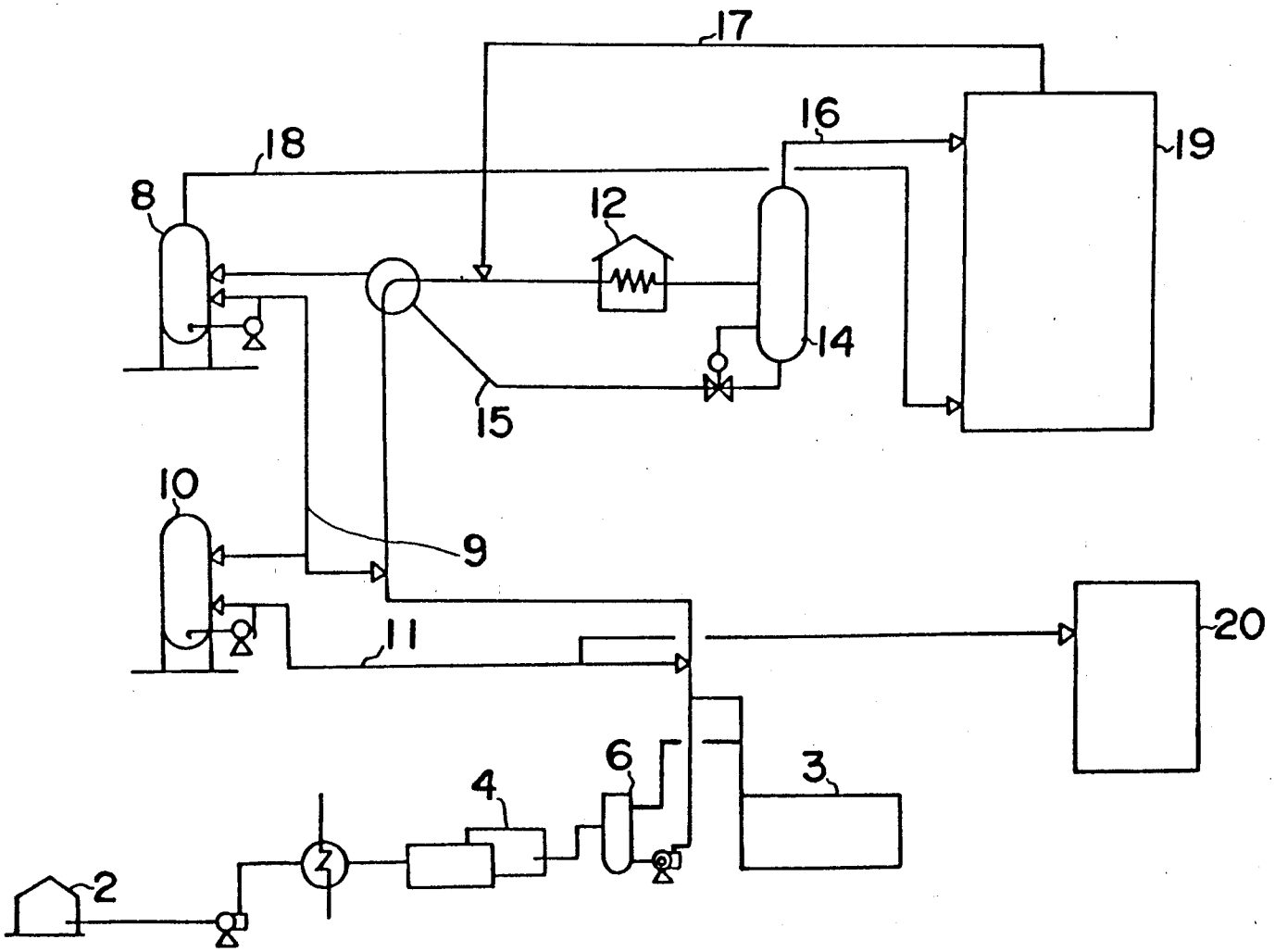
FIG. 1 represents a schematic flow chart illustrating the process of the present invention.

More specifically, the present invention provides a process for hydrodelayed thermal cracking in combination with hydrostripping, which comprises feeding crude oil from a surge tank to a crude oil stripper via a feed line; separating the crude oil into a lighter fraction and a heavier fraction in the crude oil stripper; subjecting the lighter fraction to hydrodesulfurization; feeding the heavier fraction from the crude oil stripper to a first storage tank; hydrothermally cracking the heavier fraction for at least 10 minutes under a hydrogen pressure in the first storage tank; introducing a bottom residue of the first storage tank into a second storage tank or the feed line, and subjecting a cracked and vaporized fraction of the first storage tank to hydrodesulfurization; hydrothermally cracking the residue introduced into the second storage tank under a higher hydrogen pressure than the hydrogen pressure of the first storage tank; subjecting a portion of a bottom residue of the second storage tank to hydrodemetallization, hydrodesulfurization and hydrocracking, and introducing another portion of the bottom residue of the second storage tank into the feed line; and supplying hydrogen to the surge tank to facilitate pressurizing the crude oil in the surge tank.

Crude oil and a heavier fraction thereof, when heated under hydrogen, may be easily cracked by itself, and impurities such as Ni and the like existing in the form of sulfide metal may act as a hydrodelayed thermal cracking catalyst. Usually, the treatment of heavy fractions may be performed efficiently under a higher hydrogen partial pressure and at lower temperature.

Therefore the heavier fraction drawn off from the bottom of the stripper arranged in a hydrostripping process is charged into a first residue storage tank which is kept under higher hydrogen partial pressure so that there may exist enough reaction time for hydrodelayed thermal cracking.

The residue, especially an uncracked one, of the first residue storage tank is partially recycled via a crude feed line as a donor to another storage tank installed adjacent to the first residue storage tank. The second tank is operated at 10–50 kg/cm$^2$ higher than that of the first residue storage tank. These residue storage tanks act as back-up hydrogen supply sources for the hydrostripping process in an emergency case, and at the same 15 time accelerate the performance of the hydrodelayed thermal cracking of the residue.

The two-stage hydrodelayed thermal cracking system of the invention reduces the existence of asphaltene or the like in the residue, which helps to keep the reactions smooth in the sections such as hydrodemetallization, hydrodesulfurization and hydrocracking which follow the hydrostripping unit.

Two-stage thermal treatment systems are described in U.S. Pat. No. 2,176,353 and U.S. Pat. No. 2,748,061. However, these patents are concerned with thermal cracking without using hydrogen, and the operational conditions in these patents are as follows: The temperature is above 425° C., the pressure is less than 300 psig, and the reaction time is less than 10 minutes. Furthermore, the cracking reaction is endothermic and needs too much heat.

However, in the present invention, the hydrodelayed thermal cracking reaction is a hydrocracking reaction involving hydrogenation and cracking reactions. Hydrogenation is an exothermic reaction and cracking is an endothermic reaction. Moreover, heat released by hydrogenation is much greater than heat consumed by cracking, so that hydrocracking continues as a chain reaction. Therefore, in the present invention, the conditions of the reactions are preferably as follows: Hydrogen is used, its temperature being less than 400° C., more preferably 350° C., its pressure being more than 300 psig, more preferably 30 kg/cm$^2$G, and the reaction time being more than 10 minutes, more preferably 30 minutes.

The hydrodelayed thermal cracking is a new concept which enables treatment of hydrocarbons under hydrogen without adding a catalyst, and keeping the heavier fraction at a moderate temperature less than 400° C., preferably at 250° C., at the highest hydrogen pressure section.

The process of the present invention will be described hereinafter with reference to the drawing.

Crude oil supplied from a crude tank 2 is fed to desalters 4 after being pressurized and heated, which functions to separate salt, and then sent to a surge tank 6 to separate water and the like to be pressurized again up to about 50–90 kg/cm$^2$G, depending upon product specifications. The crude oil is also mixed with make-up hydrogen 3, recycle oil from residue storage tanks 8 and 10, and optionally another appropriate oil, and then fed to a stripper 14 for a hydrostripping process after being heated up by heat exchanger and furnace 12, while recycle hydrogen is charged to the heating up section from a lighter fraction hydrodesulfurization section 19 via pipe line 17.

As described above, crude oil mixed with a large amount of hydrogen is distilled at the stripper 14 under high temperature and pressure, and separated into distillate overhead and a heavy fraction (residue). The lighter overhead fraction is fed to a lighter fraction treatment section 19 via pipe line 16 while the heavy fraction is supplied to the residue storage tank 8 via pipe line 15.

The heavy residue at the bottom of the stripper 14 is under hydrogen and at an elevated temperature of 340° C., so that the thermally cracked fraction of the heavier oil under hydrogen can be capped with hydrogen at the cracked double bond. The same reaction is also accelerated in residue storage tanks 8 and 10, the latter being kept at a higher pressure than the former.

The cracked and vaporized portion from the storage tank 8 is sent to the lighter fraction treatment section 19 via pipe line 18.

The lower temperature and the higher hydrogen pressure kept in the storage tanks contributes to an acceleration of a smooth reaction of the hydrodelayed thermal cracking.

The residue is drawn off to the residue tank 8 where hydrogen is backed up from another supply source and enough time is provided for the hydrodelayed thermal cracking reaction by recycling part of the bottom residue to the middle stage of the tank and also by adding partly to the crude feed. The bottom residue from the residue tank 8 is also fed to the residue storage tank 10 to accelerate the hydrodelayed thermal cracking reaction in the same way as at the residue storage tank 8. The bottom residue is supplied via pipe line 9 while the bottom residue from the residue storage tank 10 is sent to the following processes 20, including hydrodemetallization, hydrodesulfurization and hydrocracking, via pipe line 11. If necessary at the hydrostripping unit, the residue storage tank 10 may be used as an emergency holding unit.

By the installation of the storage tanks in accordance with this invention, and by heating crude at moderate temperature under hydrogen, the following merits have been obtained:

1. Crude oil is easy to treat.
2. Asphaltene is not detected.
3. Alkylated product is obtained.
4. The octane and cetane number are increased.
5. Heavier residue is reduced in production.
6. Gum formation is eliminated and viscosity is reduced.

The following test results have been obtained.

EXAMPLE 1

When heating Arabian light up to 410° C. under hydrogen initial pressure at 32 kg/cm$^2$ the following results are obtained.

| BP IBP °C. | Crude wt % | 410° C. wt % | |
|---|---|---|---|
| 125 | 5.3 | 3.6 | |
| 150 | 5.5 | 6.7 | |
| 200 | 10.6 | 11.6 | |
| 250 | 9.9 | 10.4 | |
| 300 | 10.6 | 11.1 | |
| 350 | 10.8 | 11.2 | |
| 500 | 25.5 | 27.2 | |
| | 21.5 | 18.6 | By ASTM STM-DIS proposed method. |

EXAMPLE 2

Asphaltene in Arabian light disappears within 120 hr, by keeping the temperature at 400° C. and the hydrogen initial pressure at 60 kg/cm$^2$.

EXAMPLE 3

Arabian light crude is heated to 325° C. without catalyst under a hydrogen initial pressure of 30 kg/cm$^2$G, keeping these conditions for 30 minutes. Kerosene distillate is increased over 10%, and middle distillate is increased over 20%. Residue is nil.

I claim:

1. A process for hydrodelayed thermal cracking in combination with hydrostripping, which comprises:

feeding crude oil from a surge tank to a crude oil stripper via a feed line;

separating said crude oil into a lighter fraction and a heavier fraction in said crude oil stripper;

subjecting said lighter fraction to hydrodesulfurization;

feeding said heavier fraction from said crude oil stripper to a first storage tank;

hydrothermally cracking said heavier fraction for at least 10 minutes under a hydrogen pressure in said first storage tank without adding a catalyst;

introducing a bottom residue of said first storage tank into a second storage tank or said feed line, and subjecting a cracked and vaporized fraction of said first storage tank to hydrodesulfurization;

hydrothermally cracking said residue introduced into said second storage tank under a higher hydrogen pressure than said hydrogen pressure of said first storage tank without adding a catalyst;

subjecting a portion of a bottom residue of said second storage tank to hydrodemetallization, hydrodesulfurization and hydrocracking, and introducing another portion of said bottom residue of said second storage tank into said feed line; and supplying hydrogen into said surge tank to facilitate pressurizing said crude oil in said surge tank.

2. The process according to claim 1, wherein said second storage tank is operated at a hydrogen pressure 10–50 kg/cm$^2$ higher than said hydrogen pressure of said first storage tank.

3. The process according to claim 1, wherein said hydrothermal cracking in said first and second storage tanks is conducted at a temperature of less than 400° C. for more than 10 minutes.

4. The process according to claim 1 wherein said hydrogen pressure in said first storage tank is more than 300 psig.

* * * * *